US008166993B2

(12) United States Patent
Childers

(10) Patent No.: US 8,166,993 B2
(45) Date of Patent: May 1, 2012

(54) METHOD AND SYSTEMS FOR USING A SHIM PLATE FOR INCREASED STRENGTH

(75) Inventor: Leonard Childers, Kingwood, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 426 days.

(21) Appl. No.: 12/553,750

(22) Filed: Sep. 3, 2009

(65) Prior Publication Data

US 2011/0048185 A1 Mar. 3, 2011

(51) Int. Cl.
*E21B 33/06* (2006.01)

(52) U.S. Cl. ..... 137/15.18; 251/1.3; 277/324; 277/325; 277/327; 137/15.01; 137/315.02; 166/55.2; 166/85.4

(58) Field of Classification Search ..... 251/1.1, 251/1.3; 277/324, 325, 327; 137/15.01, 137/15.18, 315.02; 166/55.2, 85.4
See application file for complete search history.

(56) References Cited

U.S. PATENT DOCUMENTS 2,760,749 A * 8/1956 Ratigan ..... 251/1.3
2,919,111 A * 12/1959 Nicolson ..... 166/352
3,554,480 A * 1/1971 Rowe ..... 251/1.3
3,946,806 A 3/1976 Meynier, III
4,227,543 A * 10/1980 Williams, Jr. ..... 137/246.22
4,332,367 A 6/1982 Nelson
4,341,264 A * 7/1982 Cox et al. ..... 166/55
4,347,898 A 9/1982 Jones
4,540,046 A 9/1985 Granger et al.
4,541,606 A 9/1985 Williams, Jr.
4,558,842 A * 12/1985 Peil et al. ..... 251/1.3
4,770,387 A 9/1988 Granger
4,809,421 A * 3/1989 Justice ..... 29/525.02
4,817,794 A 4/1989 Workman
4,927,112 A * 5/1990 Wilson ..... 251/1.3
5,575,452 A 11/1996 Whitby et al.
5,640,813 A * 6/1997 Glazik et al. ..... 52/126.1
5,897,094 A * 4/1999 Brugman et al. ..... 251/1.3
5,975,484 A * 11/1999 Brugman et al. ..... 251/1.3
6,244,334 B1 6/2001 Wu et al.
6,260,817 B1 * 7/2001 Lam et al. ..... 251/1.3
6,560,934 B1 5/2003 Workman
7,137,610 B2 * 11/2006 Lam ..... 251/1.3
7,207,382 B2 4/2007 Schaeper
7,234,530 B2 6/2007 Gass
7,331,562 B2 * 2/2008 Springett ..... 251/1.3
7,832,706 B2 * 11/2010 Judge ..... 251/1.3
8,066,070 B2 * 11/2011 Springett et al. ..... 166/298
2008/0001107 A1 1/2008 Gass et al.

* cited by examiner

*Primary Examiner* — Eric Keasel
*Assistant Examiner* — Minh Le
(74) *Attorney, Agent, or Firm* — Potomac Patent Group PLLC

(57) ABSTRACT

Blowout preventer (BOP) and method for sealing a well. The BOP includes a body having first and second conduits, the first conduit being substantially perpendicular on the second conduit; a piston extending through the first conduit and being configured to reciprocate inside the first conduit, the piston having a body portion, a neck portion and a head portion in this order; a ram block disposed on the piston and configured to move with the piston inside the first conduit for closing the second conduit; and a shim configured to fill a gap between a back region of the ram block and the body portion of the piston.

20 Claims, 13 Drawing Sheets

METHOD AND SYSTEMS FOR USING A SHIM PLATE FOR INCREASED STRENGTH

TECHNICAL FIELD

Embodiments of the subject matter disclosed herein generally relate to methods and devices and, more particularly, to mechanisms and techniques for reducing a gap between components of a ram blowout preventer (BOP).

BACKGROUND

One apparatus for sealing a well is the BOP. The BOP is a safety mechanism that is used at a wellhead of an oil or gas well. The BOP may be used for offshore drilling and also for land-based drilling. The BOP is configured to shut the flow from the well when certain events occur. One such event may be the uncontrolled flow of gas, oil or other well fluids from an underground formation into the well. Such event is sometimes referred to as a "kick" or a "blowout" and may occur when formation pressure exceeds the pressure generated by the column of drilling fluid. This event is unforeseeable and if no measures are taken to prevent and/or control it, the well and/or the associated equipment may be damaged.

The BOP may be installed on top of the well to seal the well in case that one of the above events is threatening the integrity of the well. One type of BOP, an annular BOP, is conventionally implemented as a valve to release the pressure either in the annular space between a casing and a drill pipe or in the open hole (i.e., hole with no casing) during drilling or completion operations. Another type of BOP, a ram BOP, can be located below the annular BOP and above the wellhead. These ram BOPs can generally be broken down into a few categories: (1) blind rams for sealing an open hole, (2) pipe rams for sealing a hole with drill pipe in use, (3) shear rams for sealing the hole and cutting the drill pipe, etc.

FIG. 1 shows a well 10 located in an offshore environment. A wellhead 12 of the well 10 may be fixed to the seabed 14. A ram BOP 16 is secured to the wellhead 12. FIG. 1 shows, for clarity, the BOP 16 detached from the wellhead 12. However, the BOP 16 is attached to the wellhead 12 or another part of the well 10. A drill pipe 18 is shown traversing the ram BOP 16 and entering the well 10. The ram BOP 16 may have two ram blocks 20 attached to corresponding pistons 22. The pistons move integrally with the ram blocks 20 along directions A and B to close the well.

A cut view of the ram BOP 16 that shows the ram blocks 20 is shown in FIG. 2. The ram blocks 20 are shown closed inside a cavity 24. The cavity 24 may be bordered, at one end, by a top seat 26 and a wear plate 28. The ram blocks 20 may include a packer 30 (which may be an elastomer) and a top seal 31, which seals the well 10 when the ram blocks 20 are closed.

In situations when the ram BOP is a pipe ram BOP used for shearing the drill pipe or other tools in the hole when sealing the well, having the desired shear strength and shared load through the desired load bearing surfaces is desired. This can be complicated by variable forces acting upon the system, such as, the reaction force produced by the drill line when asymmetrically disposed relative to the shear surface of the ram block 20, and force produced by variable upward pressure from the kick or additional items inside of the drill pipe that also need to be sheared off to seal the well, e.g., a cable attached to a down hole piece of equipment, to name just a few examples.

In addition, piston 22 may neck down into a piston rod portion 302 which includes a neck section 304 and head section 306 as shown in FIG. 3. In FIG. 3, a portion of the piston rod 302 is shown as dashed lines representing the portion of the piston rod 302 which is covered by the ram block 20 when looking from the top down. The piston rod head section 306 has a face 308 which is in contact with the ram block 20. This contact surface of the face 308 is where the force is applied from the piston 22 to the ram block 20 when closing the BOP to shear, for example, a load 314. Also shown is a gap 310 which exists between the piston rod 302 and the ram block 20 when the ram block 20 is installed. Since there is a gap 310, shoulders 312 of the piston rod 302 are not applying force from the piston rod 302 to the ram block 20. Additionally, this gap may allow undesirable twisting forces to be exerted upon the piston rod neck 304. For example, if the load 314 is asymmetrically distributed relative to the ram block 20, as shown in FIG. 3, a non-uniform force would act on head section 306, which in turn will try to bend the neck section 304 along direction A.

Accordingly, it would be desirable to provide systems and methods that can achieve the sealing of a well and shear materials in the well but also avoid the additional challenges described above.

SUMMARY

According to an exemplary embodiment there is a ram BOP for sealing a well. The ram BOP includes a body having first and second conduits, the first conduit being substantially perpendicular on the second conduit; a piston extending through the first conduit and being configured to reciprocate inside the first conduit, the piston having a body portion, a neck portion and a head portion in this order; a ram block disposed on the piston and configured to move with the piston inside the first conduit for closing the second conduit, where the ram block has a recess in a back region configured to receive the neck portion and the head portion of the piston such that a gap is formed between the back region of the ram block and the body portion of the piston across a part of the neck region of the piston; and a shim configured to fill the gap between the back region of the ram block and the body portion of the piston.

According to another exemplary embodiment, there is a method of assembling a ram block to a piston for use in a ram BOP. The method includes: extending the piston to a partially open position along an axis; placing a ram block on a piston rod of the piston such that a face of a head end of the piston rod is contacting the ram block; measuring, in a direction substantially parallel to the axis of the piston rod, a gap between the ram block and the piston rod; removing the ram block; adding material to the ram block such that when the ram block is reinstalled the gap is reduced; and reinstalling the ram block.

According to another exemplary embodiment, there is a method of shearing material in a well by a ram BOP. The method includes: engaging with a piston rod, attached to a piston, a ram block on two substantially parallel surfaces of the ram block, where a first parallel surface is between a shoulder of the piston rod and a shim attached to the ram block and a second parallel surface is between a face of the piston rod and the ram block; applying a force to the piston in a first direction such that axial forces on each of the two substantially parallel surfaces are substantially equivalent; and moving the piston rod along the first direction towards the well hole for shearing the tool.

According to another exemplary embodiment, there is a shim for filling a gap between a ram block and a piston. The shim includes a stock thickness no greater that a thickness of the gap. A shape of the shim is such that outer edges of the shim substantially match a shape of a back face of the ram block and inner edges of the shim are dimensioned to fit around a necked portion of the piston, and the shim is attachable to the ram block.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Systems and methods according to exemplary embodiments can improve load sharing on the end of the piston rod in a ram BOP and reduce the associated stress of a given load. In order to provide context for this discussion, an exemplary grouping of components within a ram BOP 400, which can take advantage of exemplary embodiments described herein, will now be described with respect to FIGS. 4 and 5.

Figure 1:
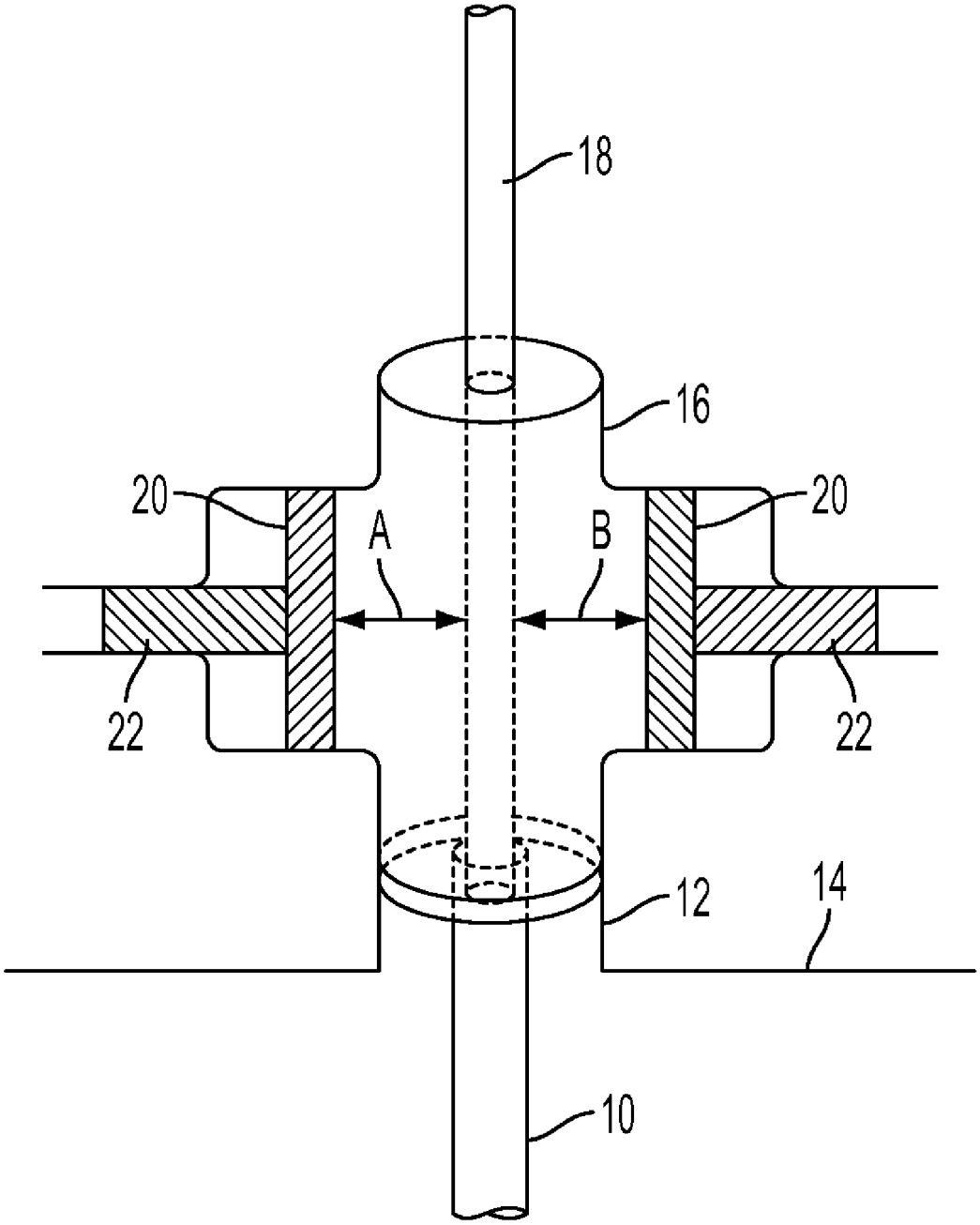
FIG. 1 PRIOR ART
FIG. 1 is a schematic diagram illustrating a ram blowout preventer (BOP) disposed on top of the well.
Figure 2:
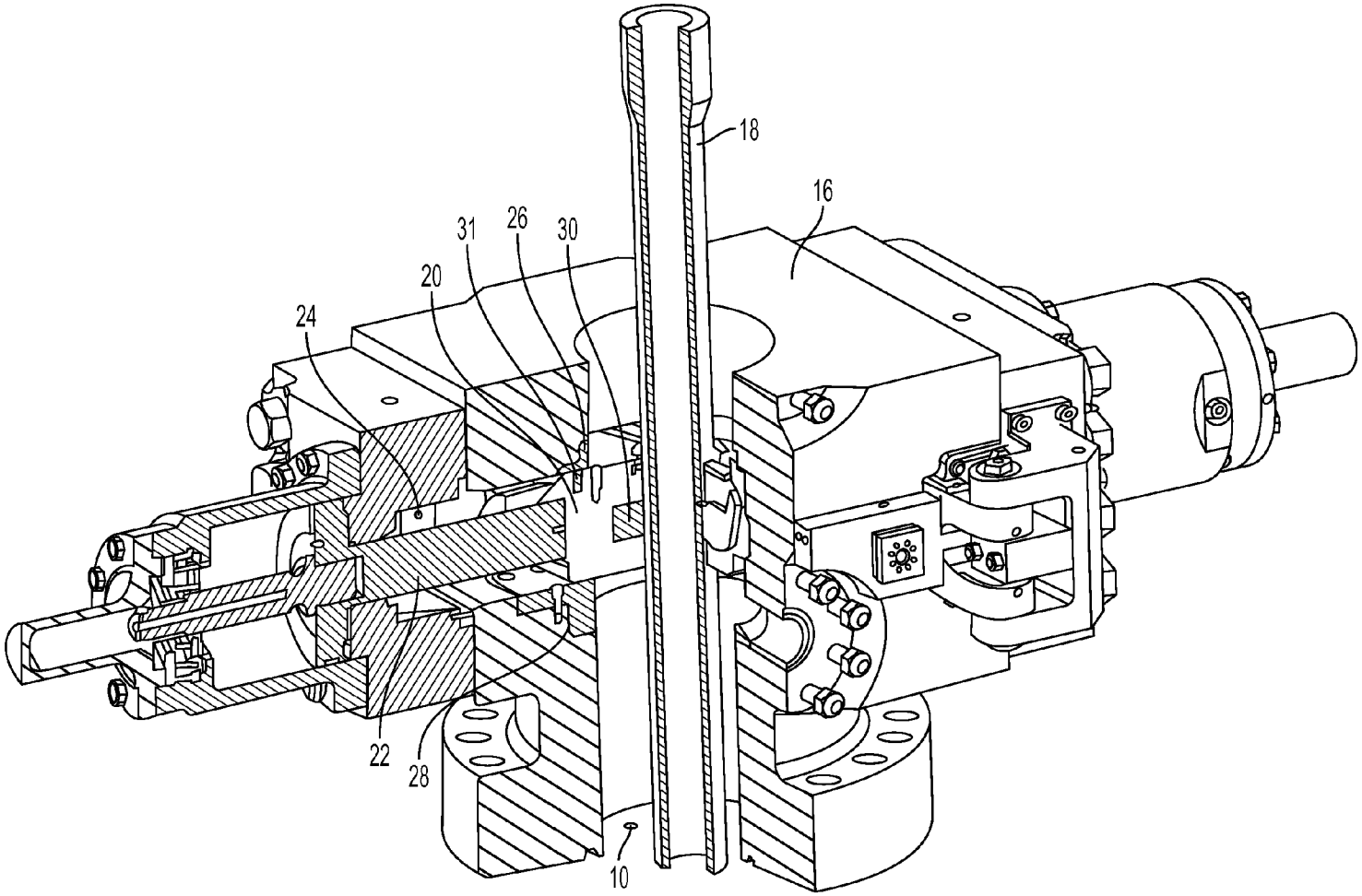
FIG. 2 PRIOR ART
FIG. 2 is a schematic diagram of a conventional ram BOP.
Figure 3:
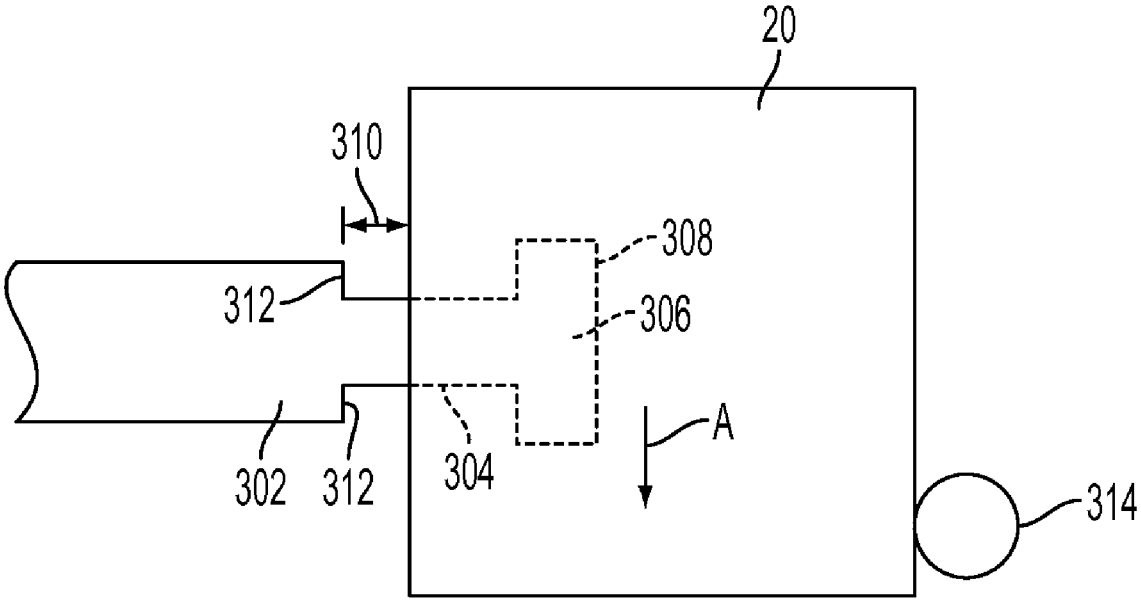
FIG. 3 shows a relationship between a piston rod and a ram block.
Figure 4:
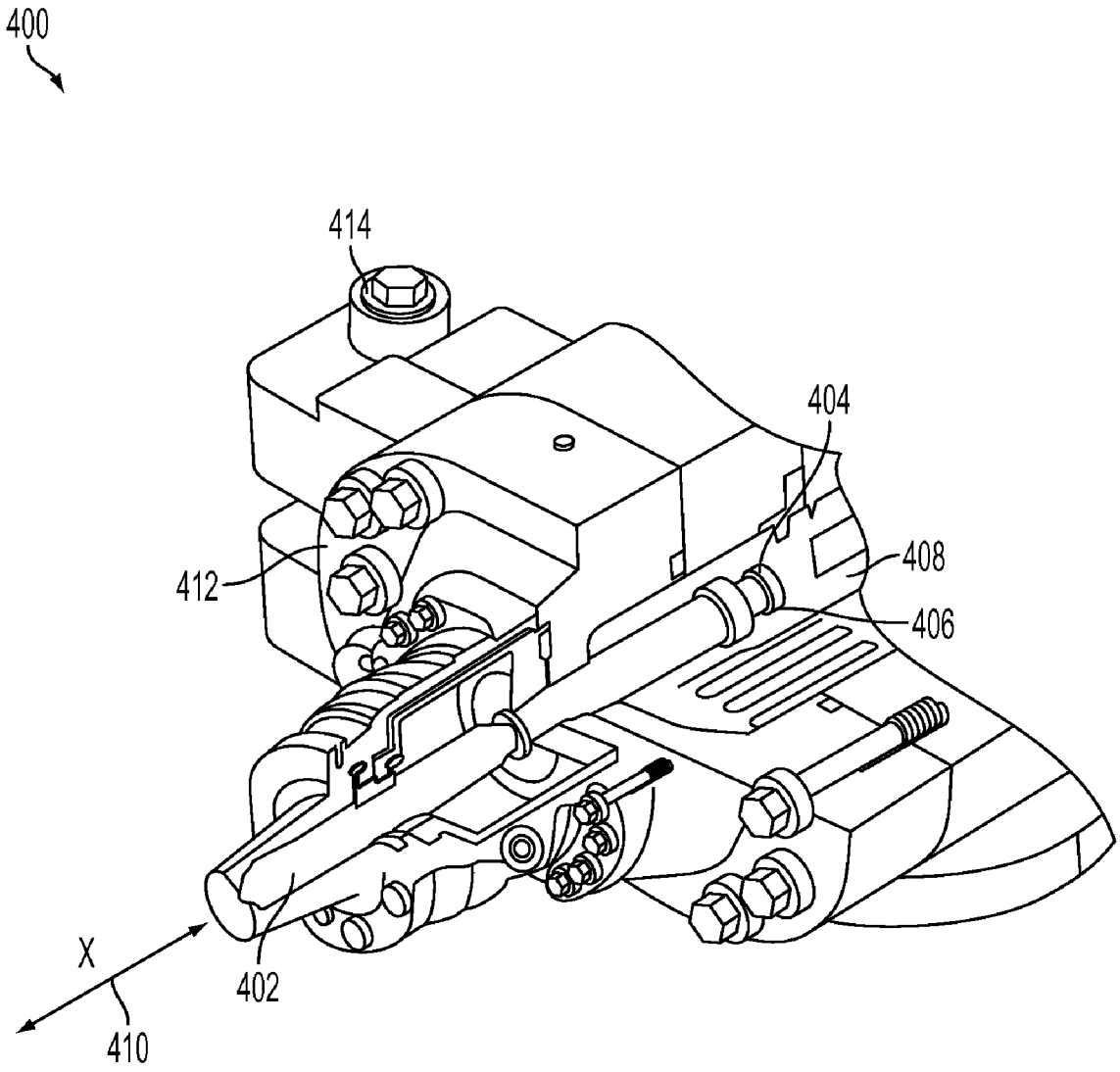
FIG. 4 shows a cut away section of a ram BOP according to exemplary embodiments.
Figure 5:
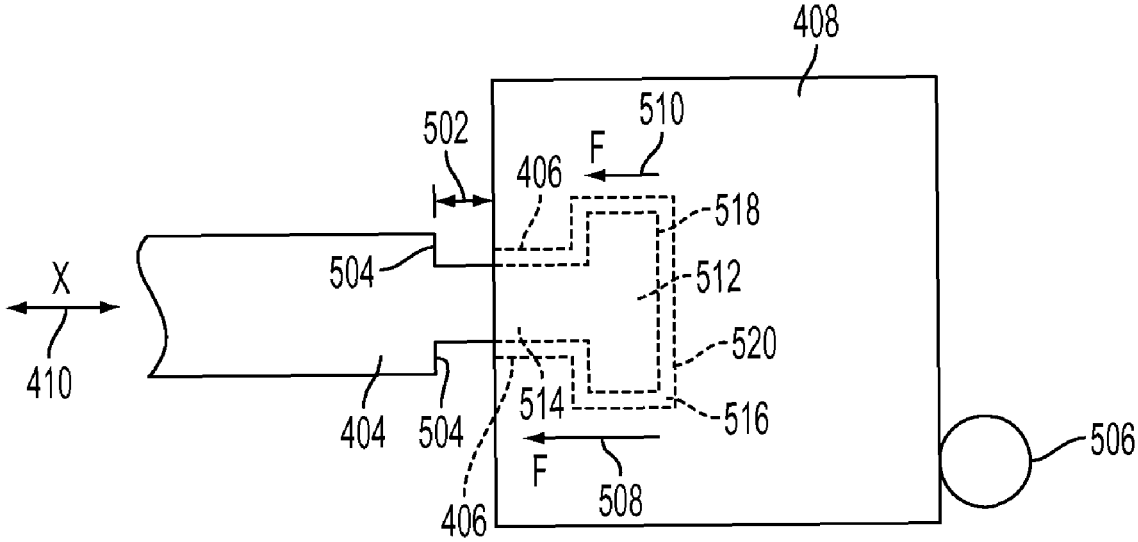
FIG. 5 shows a relationship between a piston rod, a ram block and applied forces associated with shearing an off-centered object in a well according to exemplary embodiments.

FIG. 4 shows a cut away section of a ram BOP 400 and FIG. 5 shows the relationship, when looking down, between the piston rod 404 and the ram block 408 when the ram block 408 is installed. Ram BOP 400 includes a piston 402 which has a piston rod section 404 which includes a neck section 514, a head section 512 and a slot 406 (also a second slot, shown in FIG. 5, of a similar shape and size is on the opposite side of piston rod 404). A ram block 408 used for shearing material in the well, e.g., drill pipe, cable, tools and the like, can be moved when force is applied to the piston 402 in either direction along an X axis 410. When enough force is applied to the piston 402, it can be moved along the X axis 410 to either open or close the ram block 408.

The ram BOP 400 also has a bonnet 412 which can be unbolted and swung open on the hinge 414. In one application, the bonnet 412 is unscrewed or slides away from the ram BOP 400. This allows access to the ram block 408 for removal, replacement and maintenance of the ram block 408 as desired. According to an exemplary embodiment shown in FIGS. 4 and 5, the ram block 408 is placed over a top of the piston rod 404 in order to be attached to the piston 402. The ram block 408 will remain attached to the piston 402 due to the large weight of the ram block 408 (between 100 and 400 kg). When the ram block 408 is placed over the top of the piston rod 404, e.g., the piston rod receives a cavity 516 of the ram block 408, a portion of the ram block 408 fits in the slots 406 of the piston rod 404. When the piston rod 404 is moved back and forth, the piston rod 404 physically engages the ram block 408, e.g., the surface 520 at an edge of the cavity 516, and the ram block 408 moves together with the piston 402.

However, as shown in FIG. 5, when the ram block 408 is placed on the piston rod 404 a gap 502 exists between the ram block 408 and piston rod 404. This gap 502 has a thickness which is measurable along the X axis 410. The dashed line portion of the piston rod 404 generally represents its location within the ram block 408. According to purely illustrative embodiments, the thickness of the gap 502 may be less than half an inch (1.27 cm), e.g., 0.125 in. (0.3175 cm), and the slot(s) 406 can be in the range of 1-10 inches (2.54-25.4 cm), e.g., 3.25 in. (8.255 cm), however other dimensions can be used. This gap 502 is present because heavy and large components can be difficult to machine precisely, etc.

In general operation, the piston 402, piston rod 404 and ram block 408 can be moved along the X axis 410 to either open or close the ram block 408. To close the ram block 408, a force is exerted on the piston 402 to move the ram block 408. However, since the piston rod 404 is necked down, combined with the gap 502 between the ram block 408 and the piston rod 404, no force is transferred from the piston rod shoulders 504 to the ram block 408 since they are not in contact with the ram block 408. In the case where the ram block 408 closes to shear something in the well, e.g., a cable 506, and the cable 506 is off-center of the hole, unequal forces are applied to the head portion 512 of the piston rod 404. These unequal forces are shown by a force F 508 and a force F 510. Since one tab of the piston rod head 512 is closer to the contact point(s) between the ram block 408 and the cable 506, force F 508 is greater than force f 510. This difference in force can create an undesirable twisting to the necked portion 514 of the piston rod 404.

Figure 6:
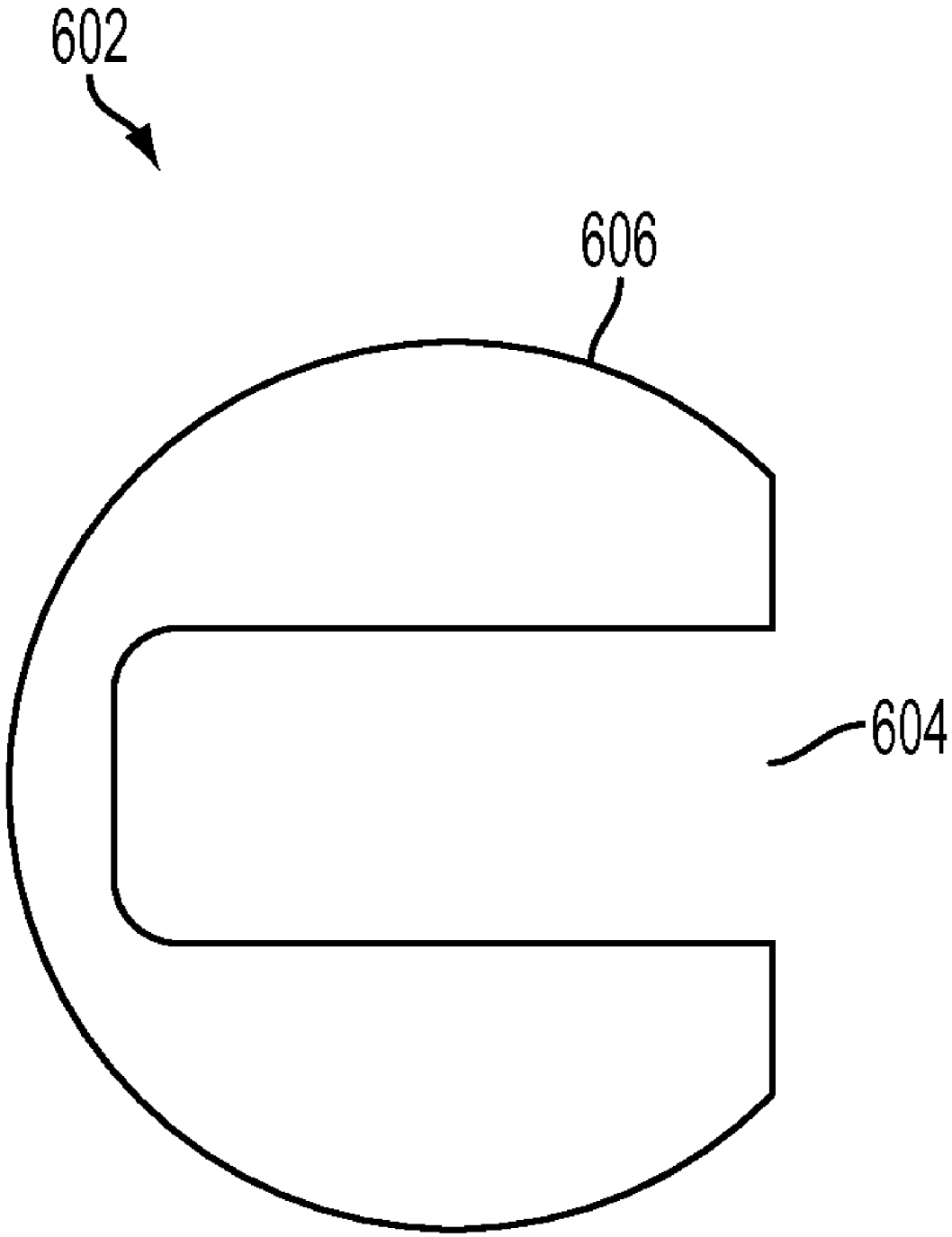
FIG. 6 illustrates a shim according to exemplary embodiments.
Figure 7:
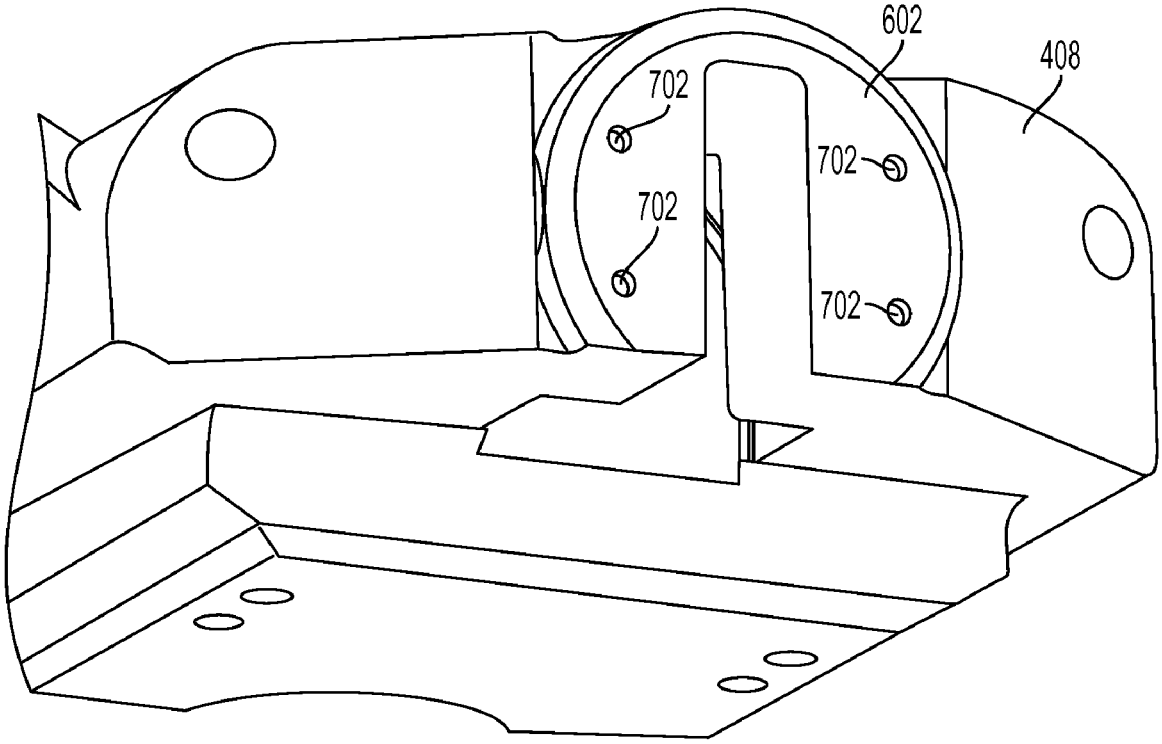
FIG. 7 depicts a shim attached to a ram block according to exemplary embodiments.

According to exemplary embodiments, various systems and methods can be used to fill the gap 502 between the ram block 408 and the piston rod 404 such that the axial load initially exerted on the piston 402 is transferred across the shoulders 504 of the piston rod 404 to the ram block 408. Additionally, the removal of the gap 502 reduces the potential twisting applied to the piston rod neck 514. According to one exemplary embodiment, the shim can be shaped to fit substantially around the neck portion of the piston rod 404 and the shim has a radius along the outer edge of the shim which is greater than or equal to a radius of a face of the head portion of the piston rod 404. For example, according to exemplary embodiments, a shim 602 as shown in FIG. 6 can be used to fill the gap 502. Shim 602 is shown here as a "horseshoe" shaped shim that can be attached to the ram block 408. In an exemplary embodiment, the shim 602 may be bolted to the ram block 408 (bolt holes not shown). However, other attachment options such as adhesives or welding could be used. When attached to the ram block 408, the face of the shim 602 is substantially parallel to the face 518 of the piston rod head 512 and the contact points on the shim 602, e.g., the shoulders 504 of the piston rod 404 and the ram block 408. The size and shape of shim 602 is a function of the thickness of the gap 502, the size and shape of the piston rod head 512 and the size and shape of the piston rod neck 514. While a horseshoe shaped shim 602 is shown in FIGS. 6 and 7, other shapes may be used as desired, e.g., two crescent shaped shims. According to exemplary embodiments, shim 602 has yield strength equal to, or greater than that of the piston rod 404, e.g., in the neighborhood of 135K psi (930.8 KPa). Additionally, according to one exemplary embodiment shim 602 may be constructed from 4340 alloy steel which is then heat treated to attain the desired strength.

The shim 602 is configured to fit closely around the piston rod neck 514 without completely surrounding it as shown by the open portion 604 of the shim 602. The outer portion 606 of the shim 602 is dimensioned to approximate the shape of the piston rod head 512 such that when the shim 602 is in place around the piston rod neck 514 the resultant form is similar to the form of the piston rod head 512. In one exemplary embodiment, the desired thickness of the shim 602 is achieved by grinding or machining off stock from the shim 602 until the shim 602 is roughly the thickness of the gap, e.g., one or two thousandths of an inch (0.01 mm or 0.0508 mm) thinner than the gap 502, or to have a thickness in the range of 2.54 cm to 25.4 cm, or when possible driving the thickness of the gap to zero, e.g., 0.01 mm or less. This allows close contact of the piston rod 404, shim 602 and ram block 408 which results in increased load sharing along the X axis 410. Also, according to other exemplary embodiments, other shapes and configurations of shim 602 can be used as desired. An example of shim 602 attached to ram block 408 is shown in FIG. 7 which achieves this purpose, i.e., shim 602 substantially fills the gap 502. Additionally, according to one exemplary embodiment, shim 602 has holes 702 for allowing shim 602 to be bolted (or screwed into) to ram block 408, however, according to other exemplary embodiments, shim 602 may not have holes and may be attached to ram block 408 by other means.

Figure 8:
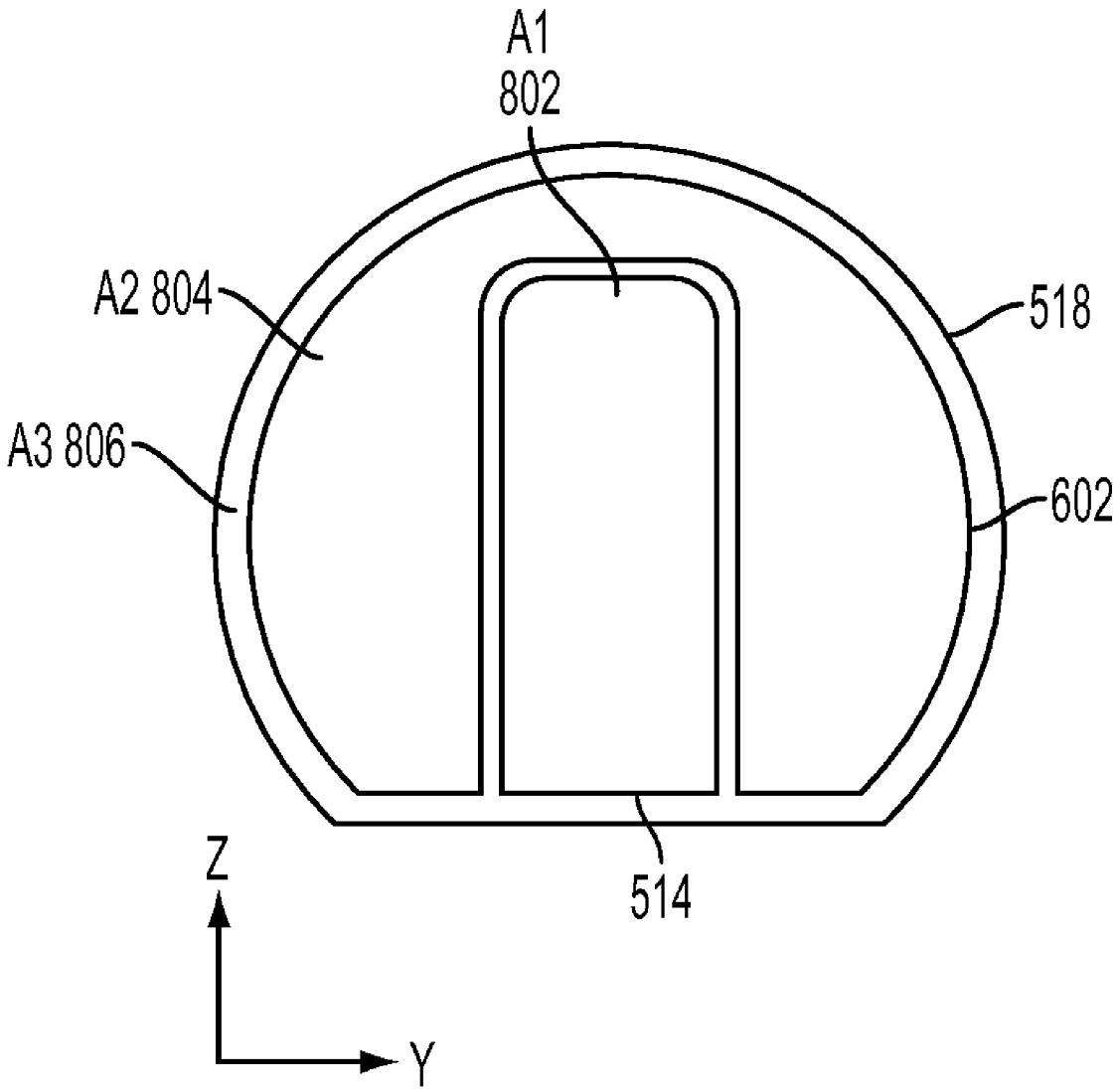
FIG. 8 shows relative surface areas of the piston rod face, the piston rod neck and the shim according to exemplary embodiments.

The amount of load sharing from the piston 402 to the ram block 408 in a conventional ram BOP is limited by the surface area of the piston rod neck 514 along a plane YZ perpendicular to the X direction 410. According to exemplary embodiments, when using the desired shim 602 (or other method of filling the gap 502), the load can be shared across the new larger surface area described by the surface area of the piston rod neck 514 along the YZ plane and the surface area of the shim 602, which approaches the surface area of the piston rod head 512. For example, as illustrated in FIG. 8, the surface area of the piston rod neck 514 is shown as surface A1 802, the surface area of the shim 602 is shown as A2 804 and the surface area of the face 518 of the piston rod 404 is shown as surface A3 806. All these surfaces are substantially parallel (within manufacturing tolerances) to the YZ plane. Combining the surface area A1 802 with the surface area A2 804 results in a total surface area which can, according to an exemplary embodiment, substantially equal the surface area A3 806. It should be understood by those of ordinary skill in the art that the shim 602 may be a single shim, e.g., a horseshoe shaped shim of the desired thickness, multiple shims, e.g., two crescent shaped shims of the desired thickness, or stacks of shims and combinations thereof.

Figure 9:
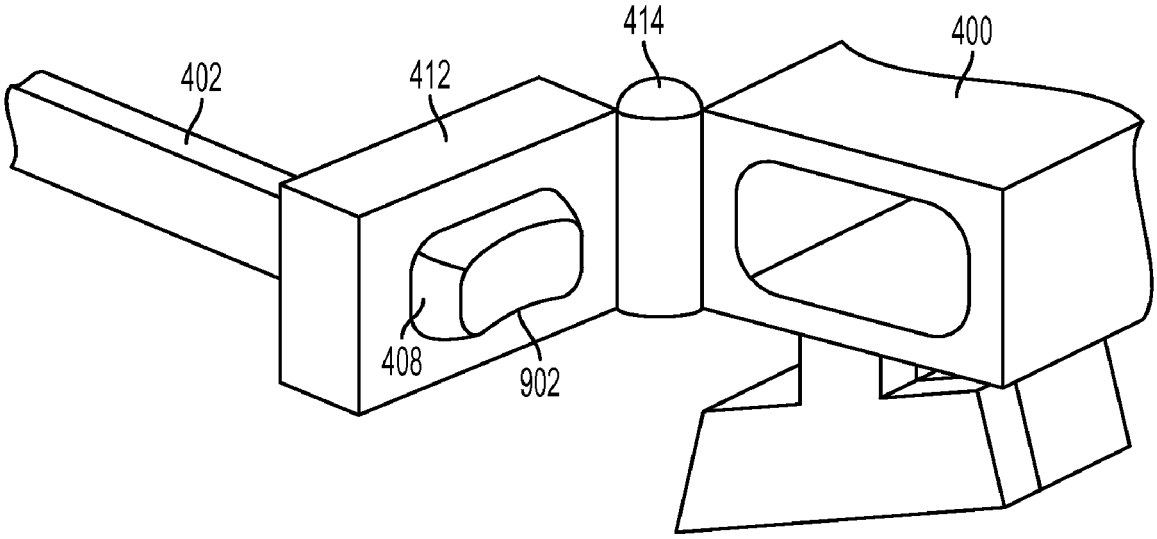
FIG. 9 depicts a partially opened BOP according to exemplary embodiments.
Figure 10:
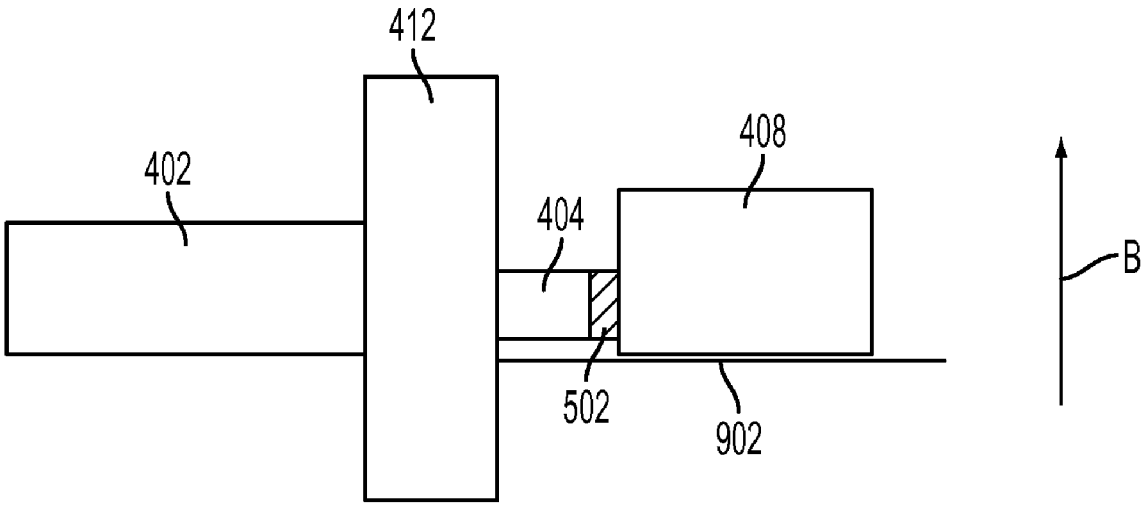
FIG. 10 shows a side view of a piston rod, bonnet and ram block prior to removing the ram block according to exemplary embodiments.
Figure 11:
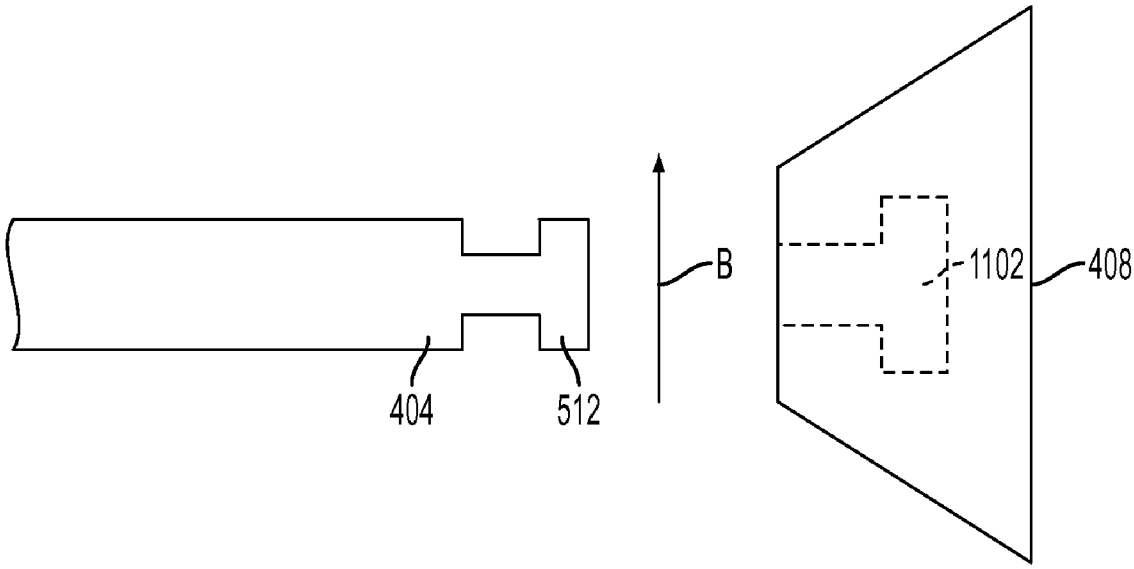
FIG. 11 shows a piston, attached piston rod and a detached ram block according to exemplary embodiments.

According to exemplary embodiments as described above, the gap 502 can be measured between the ram block 408 and the piston rod 404 as will be discussed next. As shown in FIGS. 9-11 the ram BOP 400 can be opened up to allow for easy measurement of the gap 502 and the removal and installation of the ram block 408. After the bonnet 412 of the ram BOP 400 is opened, the ram block 408 is moved with the piston road 402 to a partially open position, which allows clearance for removal of the ram block 408. The bonnet 412 is unbolted from the ram BOP 400 and swung open on the hinge 414 as shown in FIG. 9. The ram block 408 is mainly supported by the bonnet 412 and a base piece 902 attached to the bonnet 412. A side view is shown in FIG. 10, which shows the piston 402 going through the bonnet 412 with the piston rod 404 entering the ram block 408. Additionally, the base piece 902 and the gap 502 are shown here. At this point, the gap 502 between the piston rod shoulders 312 and the ram block 408 is measured. Then, the ram block 408 can be lifted off from the piston rod 404 along direction B, as shown in FIGS. 10 and 11. FIG. 11 shows a view looking down from above onto the piston 402 and piston rod 404 as well as a view looking down from above onto the ram block 408, removed from the piston rod 404. A dashed line section which shows a cavity 1102 where the piston rod 404 lies within/below the ram block 408 is also shown. As can be seen from FIG. 11, the ram block 408 may need to be lifted vertically (along direction B) at least until it clears the piston rod head 512 for removal. However, according to other exemplary embodiments, different configurations for ram BOP 400 can be used such that the ram block 408 is removed in a horizontal manner. Additionally, FIG. 11 shows which surfaces are in contact when the piston rod 404 engages the ram block 408 for movement to either open or close the ram block 408. Based on the measurement gap 502, an appropriate shim 602 is machined to correct dimensions and attached to a back portion of the ram block 408 as shown in FIG. 7. Then, the ram block 408 is positioned back on the piston rod 404.

According to an exemplary embodiment, a shim for filling a gap between a ram block and a piston in a blowout preventer may include a stock having a thickness no greater that a thickness of the gap. The shape of the shim is such that outer edges of the shim substantially match a shape of a back face of the ram block and inner edges of the shim are dimensioned to fit around a necked portion of the piston, and the shim is attachable to the ram block.

Figure 12:
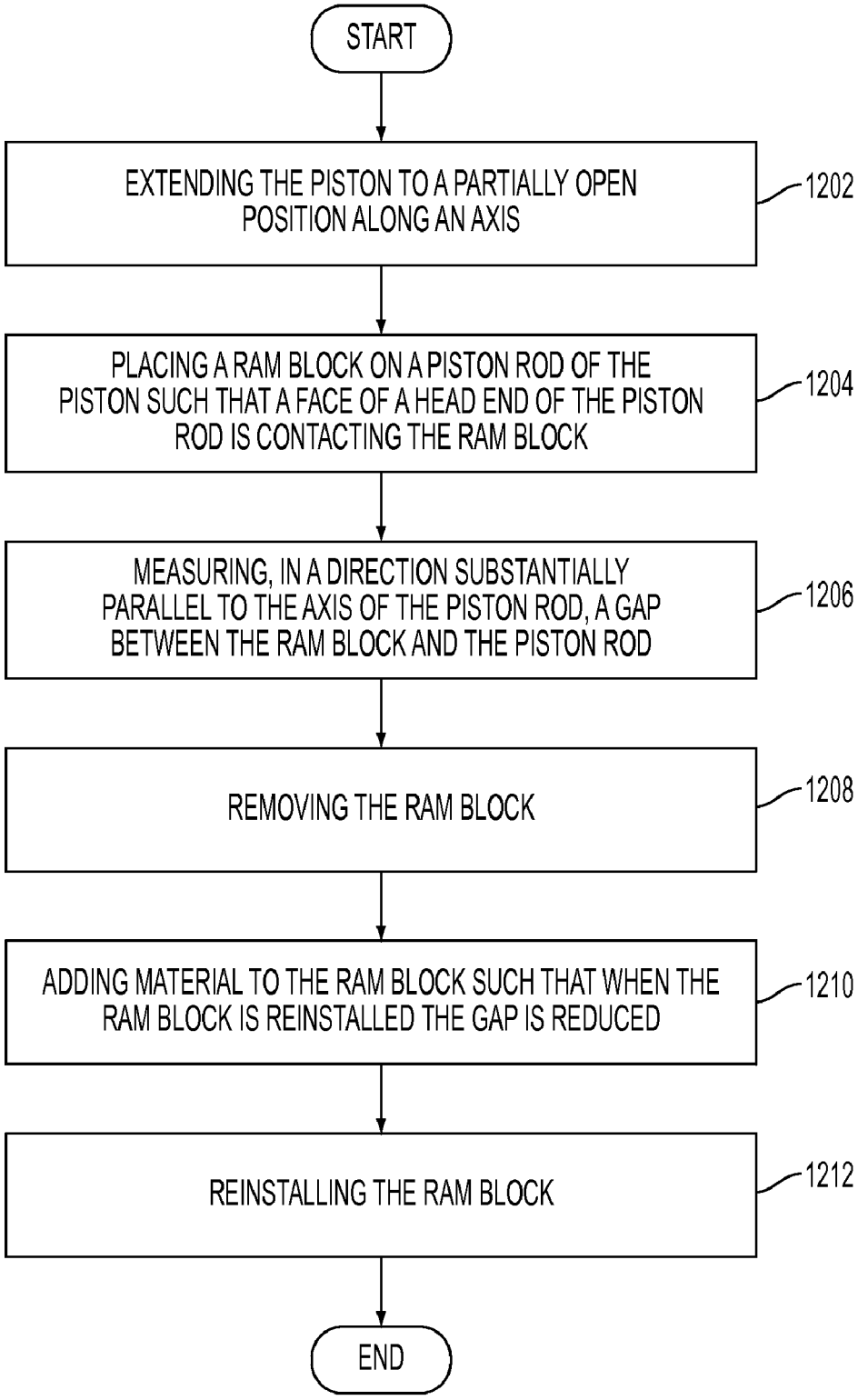
FIG. 12 illustrates a method flowchart for assembly of a ram block according to exemplary embodiments.

As described above, the gap 502 can be filled to allow contact between the piston rod 404 and the ram block 408 in this location, i.e., increase a contact area between the piston rod 404 and the ram block 408. According to exemplary embodiments, a method for assembly of a ram block 408, which fills this gap will now be described with respect to the flowchart of FIG. 12. The method of assembling a ram block 408 to a piston 402 for use in a ram BOP 400 includes: extending the piston 402 to a partially open position along an axis in step 1202; placing a ram block 408 on a piston rod 404 of the piston 402 such that a face of a head end 512 of the piston rod 404 is contacting the ram block 408 in step 1204; measuring, in a direction substantially parallel to the axis of the piston rod 404, a gap 502 between the ram block 408 and the piston rod 404 in step 1206; removing the ram block 408 in step 1208; adding material to the ram block 408 such that when the ram block 408 is reinstalled the gap 502 is reduced in step 1210; and reinstalling the ram block 408 in step 1212.

While the exemplary embodiments described above may use a shim 602 or the like for filling the gap 502 other exemplary methods can be used. According to one exemplary embodiment the ram block 408 can be made to a certain size such that no gap 502 (or just enough gap 502 to allow installation) exists. The ram block 408 can then, as needed, be machined or ground down to the desired size for installation which still allows the desired axial load sharing capabilities described above to occur. Alternatively, material can be deposited upon the desired surface of the ram block 408 to build it up to the desired size to remove the gap 502. This deposited material can also be machined off or ground down if too much is deposited. Additionally, the mating surfaces of the piston rod 404 and/or the ram block 408 can be ground or polished to a desired surface characteristic, e.g., surface finish, parallelism between features and the like, to both aid in installation to result in the desired axial load sharing capabilities.

It is noted that ram blocks 408 are generally interchangeable parts for a ram BOP 400. That is, the ram blocks 408 may be removed and replaced on an existing ram BOP 400 at desired intervals. In addition, one particular type of ram block 408 may be adapted to fit into more than one ram BOP 400. For example, it is common to install multiple BOPs in a BOP stack. By using similar ram BOPs 400, it enables a ram block 408 to be used in more than one ram BOP 400. Thus, it is likely that a gap 502 is present between the ram block 408 and the piston rod 404 irrespective of how accurately these parts are machined and the method described above corrects this problem.

Figure 13:
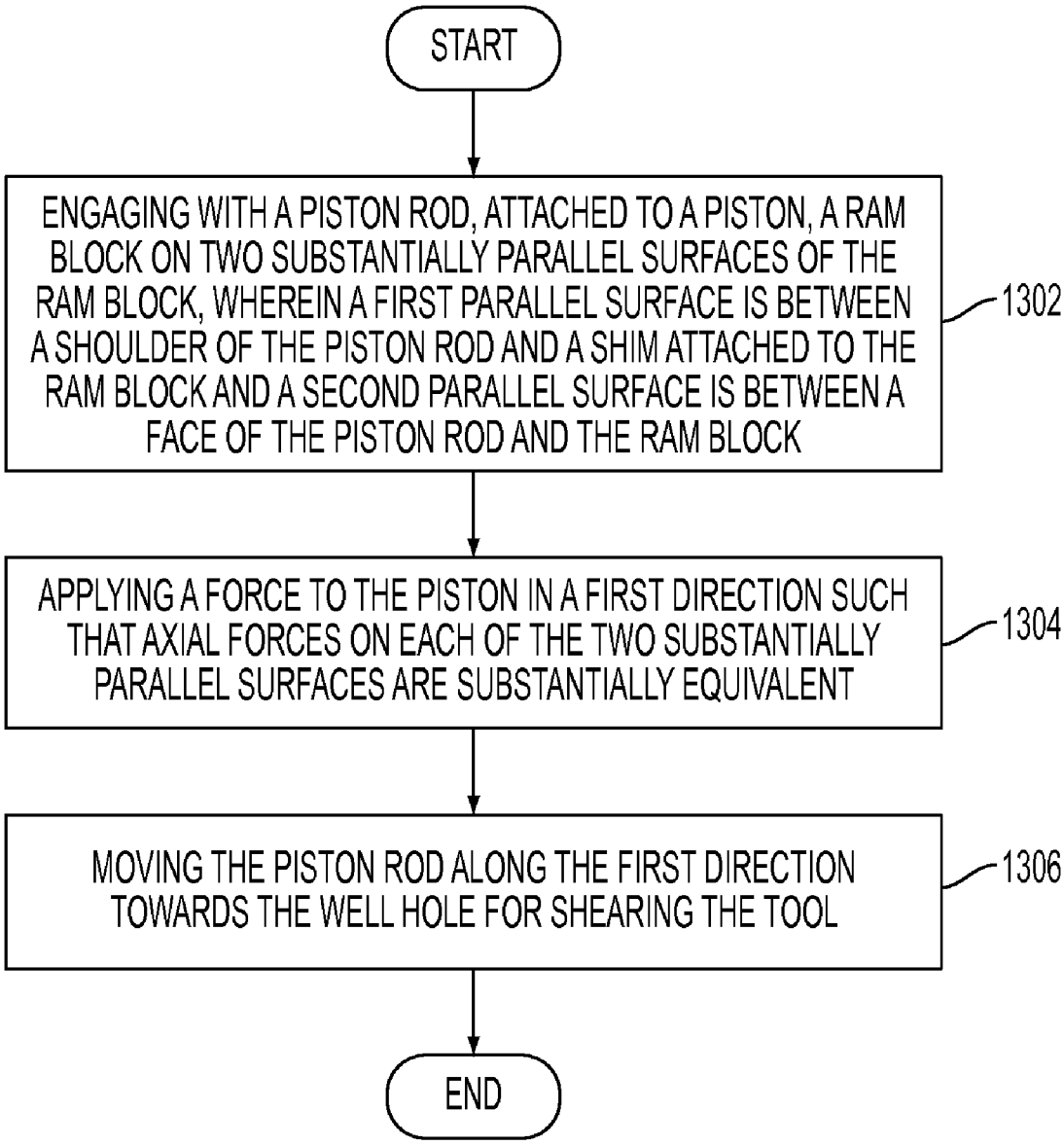
FIG. 13 shows method flowchart for shearing a tool in a well according to exemplary embodiments.

According to another exemplary embodiment, a method of shearing a tool in a well will now be described with respect to the flowchart shown in FIG. 13. A method of shearing the tool in a well by a ram BOP 400 includes: engaging with a piston rod 404, attached to a piston 402, a ram block 408 on two substantially parallel surfaces of the ram block 408, where a first parallel surface is between a shoulder of the piston rod 404 and a shim 602 attached to the ram block 408 and a second parallel surface is between a face of the piston rod 404 and the ram block 408 in step 1302; applying a force to the piston 402 in a first direction such that axial forces on each of the two substantially parallel surfaces are substantially equivalent in step 1304; and moving the piston in the first direction towards the well hole for shearing the tool in step 1306.

The above-described exemplary embodiments are intended to be illustrative in all respects, rather than restrictive, of the present invention. Thus, the present invention is capable of many variations in detailed implementation that can be derived from the description contained herein by a person skilled in the art. For example, exemplary embodiments described above allow for resisting the twisting and compression of a neck portion 514 of the piston rod 404 when acting on a tool by having the shim 602 fill in the gap. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

The invention claimed is:

1. A ram blowout preventer (BOP) for sealing a well, the ram BOP comprising:

a body having first and second conduits, the first conduit being substantially perpendicular to the second conduit;

a piston extending through the first conduit and being configured to reciprocate inside the first conduit, the piston having a body portion, a neck portion and a head portion in this order, wherein a thickness of the neck portion along a direction substantially perpendicular to the first and second conduits is smaller than a thickness of the body portion and the head portion along the same direction;

a ram block disposed on the piston and configured to move with the piston inside the first conduit to close the second conduit, wherein the ram block has a recess in a back region configured to receive the neck portion and the head portion of the piston such that a gap is formed between the back region of the ram block and the body portion of the piston across a part of the neck region of the piston; and a shim configured to fill the gap between the back region of the ram block and the body portion of the piston.

2. The ram BOP of claim 1, wherein the shim is detachable.

3. The ram BOP of claim 1, wherein the shim has a thickness in the range of 2.54 cm to 25.4 cm.

4. The ram BOP of claim 1, wherein the shim is shaped to fit substantially around the neck portion of the piston rod and the shim has a radius along an outer edge of the shim which is greater than or equal to a radius of a face of the head portion of the piston rod.

5. The ram BOP of claim 4, wherein the shim is horseshoe shaped.

6. The ram BOP of claim 1, wherein the shim is screwed into the ram block.

7. A method of assembling a ram block to a piston for use in a ram blowout preventer (BOP), the method comprising:

extending the piston to a partially open position along an axis;

placing a ram block on a piston rod of the piston such that a face of a head end of the piston rod is contacting the ram block;

measuring, in a direction substantially parallel to the axis of the piston rod, a gap between the ram block and the piston rod;

removing the ram block;

adding material to the ram block such that when the ram block is reinstalled the gap is reduced; and reinstalling the ram block.

8. The method of claim 7, wherein the step of adding material comprises:

removing material from a shim; and attaching the shim to the ram block.

9. The method of claim 8, wherein said shim is a horseshoe shaped shim or a two piece crescent shaped shim.

10. The method of claim 8, wherein the step of attaching the shim to the ram block is performed by at least one of bolting, welding or adhering.

11. The method of claim 7, wherein the reduced gap size is within the range of 0.01 mm to 0.0508 mm.

12. The method of claim 7, wherein the step of placing comprises:

actuating the piston to displace the ram block for a predetermined distance before measuring the gap such that a head region of the piston rod contacts the ram block.

13. The method of claim 7, wherein a slot formed in a neck region of the piston rod is completely filled with a back portion of the ram block and the shim such that the gap is substantially eliminated.

14. A method of shearing a tool in a well by a ram blowout preventer (BOP), the method comprising:

engaging with a piston rod, attached to a piston, a ram block on two substantially parallel surfaces of the ram block, wherein a first parallel surface is between a shoulder of the piston rod and a shim attached to the ram block and a second parallel surface is between a face of the piston rod and the ram block;

applying a force to the piston in a first direction such that axial forces on each of the two substantially parallel surfaces are substantially equivalent; and moving the piston rod along the first direction towards the well hole for shearing the tool.

15. The method of claim 14, further comprising:

engaging with the piston rod the ram block in a second direction to open the ram block, wherein the second direction is different from the first direction; and moving the rod in the second direction away from the well hole.

16. The method of claim 14, further comprising:

resisting the twisting and compression of a neck portion of the piston rod when acting on a tool by having the shim fill in the gap.

17. A shim for filling a gap between a ram block and a piston in a blowout preventer, the shim comprising:

a stock having a thickness no greater that a thickness of the gap, wherein a shape of the shim is such that outer edges of the shim substantially match a shape of a back face of the ram block and inner edges of the shim are dimensioned to fit around a necked portion of the piston, and the shim is attachable to the ram block.

18. The shim of claim 17, wherein the shim is at least one of a horseshoe shaped shim and a two piece crescent shaped shim.

19. The shim of claim 17, wherein the shim is comprised of multiple shims.

20. The shim of claim 17, wherein the shim is manufactured from 4340 heat treated alloy steel.

* * * * *